US006538614B2

(12) United States Patent
Fleming et al.

(10) Patent No.: US 6,538,614 B2
(45) Date of Patent: Mar. 25, 2003

(54) BROADBAND ANTENNA STRUCTURE

(75) Inventors: Debra A. Fleming, Berkeley Heights, NJ (US); George Earl Peterson, Warren, NJ (US); John Thomson, Jr., Spring Lake, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/836,024

(22) Filed: Apr. 17, 2001

(65) Prior Publication Data

US 2002/0149529 A1 Oct. 17, 2002

(51) Int. Cl.[7] ..... H01Q 13/10
(52) U.S. Cl. ..... 343/767; 343/770; 343/822
(58) Field of Search ..... 343/700 MS, 767, 343/731, 821, 822, 770; 333/26, 21 A

(56) References Cited

U.S. PATENT DOCUMENTS

| | | | | | |
|---|---|---|---|---|---|
| 3,784,933 | A | * | 1/1974 | Scherer et al. | 333/26 |
| 5,070,340 | A | | 12/1991 | Diaz | 343/767 |
| 5,142,255 | A | | 8/1992 | Chang et al. | 333/204 |
| 5,227,808 | A | | 7/1993 | Davis | 343/915 |
| 5,428,364 | A | * | 6/1995 | Lee et al. | 343/767 |
| 5,519,408 | A | * | 5/1996 | Schnetzer | 343/767 |
| 5,568,159 | A | * | 10/1996 | Pelton et al. | 343/767 |
| 5,598,174 | A | | 1/1997 | Erkocevic et al. | 343/795 |
| 5,896,071 | A | | 4/1999 | Dai et al. | 333/193 |
| 5,949,382 | A | | 9/1999 | Quan | 343/767 |
| 5,955,997 | A | | 9/1999 | Ho et al. | 343/767 |
| 5,986,617 | A | | 11/1999 | McLellan | 343/860 |
| 6,008,770 | A | | 12/1999 | Sugawara | 343/767 |
| 6,031,504 | A | | 2/2000 | McEwan | 343/786 |
| 6,043,785 | A | * | 3/2000 | Marino | 343/767 |
| 6,061,035 | A | | 5/2000 | Kinasewitz et al. | 343/853 |
| 6,097,273 | A | | 8/2000 | Frye et al. | 336/200 |
| 6,140,886 | A | | 10/2000 | Fratti et al. | 333/26 |
| 6,208,308 | B1 | * | 3/2001 | Lemons | 343/785 |
| 6,239,761 | B1 | * | 5/2001 | Guo et al. | 343/767 |

FOREIGN PATENT DOCUMENTS

| | | | |
|---|---|---|---|
| EP | 0257881 | 2/1988 | H01Q/13/08 |
| EP | 0401978 | 12/1990 | H01Q/13/08 |
| EP | 0 474 490 A1 | 9/1991 | H01Q/9/04 |

OTHER PUBLICATIONS

R. Mongia, I. Bahl and P. Bhartia, "Microstrip Lines and Slotlines", RF and Microwave Coupled–Line Circuits, Artech House, Boston, pp. 448 and 341.

* cited by examiner

*Primary Examiner*—Tan Ho
(74) *Attorney, Agent, or Firm*—Ozer Teitelbaum

(57) ABSTRACT

An antenna structure including at least one planar antenna element. In place of a balun, the antenna structure further includes a slotline for coupling the planar antenna element with an unbalanced load.

16 Claims, 6 Drawing Sheets

BROADBAND ANTENNA STRUCTURE

FIELD OF THE INVENTION

The present invention relates to antennas.

BACKGROUND OF THE INVENTION

A balun is an electromagnetic device for interfacing a balanced impedance, such as an antenna, with an unbalanced impedance. A balanced impedance may be characterized by a pair of conductors, in the presence of a ground, which support the propagation of balanced signals therethrough. A balanced signal comprises a pair of symmetrical signals, which are equal in magnitude and opposite in phase. In contrast, an unbalanced impedance may be characterized by a first conductor for supporting the propagation of unbalanced (i.e., asymmetrical) signals therethrough with respect to a second conductor (i.e., ground). A balun converts the balanced signals propagating through the balanced impedance to unbalanced signals for propagating through the unbalanced impedance, and vice versa.

Baluns have been employed in various applications. One such application for baluns is in radio frequency ("RF") antenna structures. An antenna structure typically comprises at least one balanced impedance—for radiating and/or capturing electromagnetic energy—coupled with a receiver, transmitter or transceiver by means of an unbalanced impedance. For example, an antenna structure formed from a balanced transmission line may be coupled with the receiver/transmitter/transceiver through an unbalanced transmission line formed from a 50 Ω coaxial cable. Here, a balun is employed as an interface between the balanced transmission line and the 50 Ω coaxial cable.

The inclusion of a balun, however, has a limiting effect on the frequency response of an antenna structure. Antenna structures using baluns typically radiate and/or capture electromagnetic energy within a singular frequency band. By incorporating a balun, multiple antenna structures are required to support a number of frequency bands. For example, a multipurpose wireless device might require a first antenna structure to support a cellular phone (900 MHz) band, a second antenna structure to support a personal communication services (2 GHz) band, and a third antenna structure to support an air-loop communication services band (4 GHz).

The frequency limitations of baluns in antenna structures has now become a problem. Presently, a growing commercial interest exists in providing an increasing number of applications and services to multi-purpose wireless devices. In an effort to minimize the additional antenna structures required for each of these increased services, and thereby reduce the complexity of the overall multi-purpose wireless device, industry has begun to explore a singular antenna structure having a broader frequency response characteristics. Consequently, an alternative to the balun is needed to increase the number of frequency bands supported by a singular antenna structure.

SUMMARY OF THE INVENTION

We have invented an antenna structure capable of supporting an increased number of frequency bands. More particularly, we have invented an interface between the balanced impedance and an unbalanced impedance, which does not have the balun's limiting effect on an antenna structure's frequency response. In accordance with the present invention, a slotline couples an antenna structure formed from a balanced transmission line, for example, with an unbalanced transmission line, such as a coaxial cable, for example. We have recognized that the frequency response of an antenna structure may broadened by replacing a balun with a slotted transmission line (e.g., slotline).

BRIEF DESCRIPTION OF THE DRAWINGS

The present invention will be better understood from reading the following description of non-limiting embodiments, with reference to the attached drawings, wherein below.

DETAILED DESCRIPTION OF THE PRESENT INVENTION

Figure 1:
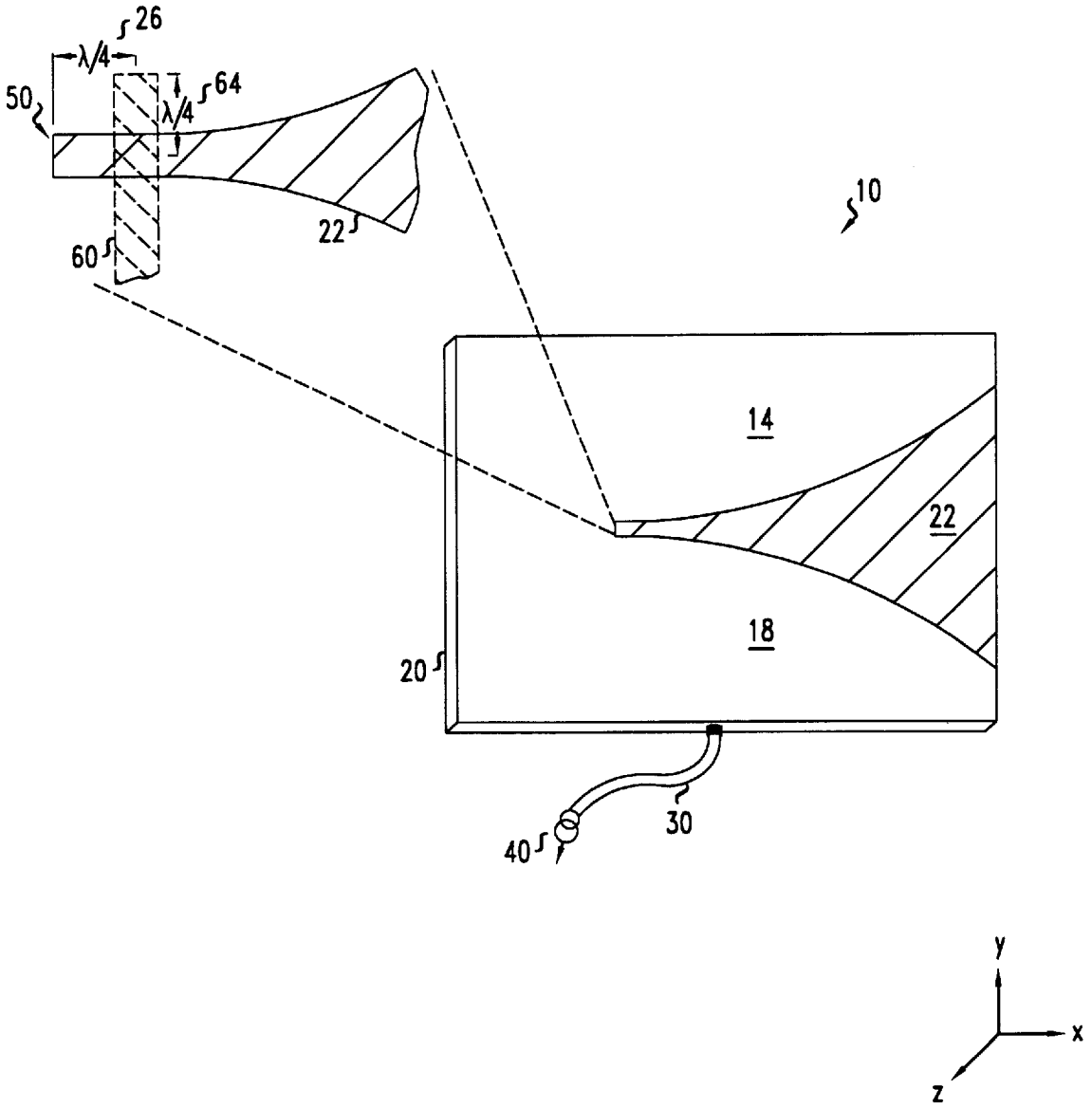
FIG. 1 is a perspective view of a known antenna structure.

Referring to FIG. 1, a perspective view of a known antenna structure 10 employing a balun is shown. Antenna structure 10 radiates and/or captures electromagnetic energy. Antenna structure 10 has a balanced configuration. More particularly, antenna structure 10 comprises a first and a second conductive film or leaf, 14 and 18, formed on a dielectric substrate 20. First and second conductive leaves, 14 and 18, support the propagation of balanced signals therethrough—i.e., a symmetrical pair of signals which are equal in magnitude and opposite in phase. Separating first and second leaves, 14 and 18, is an expanding non-conductive, tapered slot 22. Tapered slot 22 exposes the dielectric characteristics of substrate 20 such that antenna structure 10, as depicted, has a planar, travelling wave design. As shown, antenna structure 10 may be classified as an endfire-type because it radiates and/or captures electromagnetic energy from its exposed end—i.e., in the direction of the x-axis.

Coupled with antenna structure 10 is an unbalanced impedance 30. Unbalanced impedance 30 comprises a first conductor for supporting the propagation of unbalanced (i.e., asymmetrical) signals therethrough with respect to a second conductor (i.e., ground). Unbalanced impedance 30 commonly comprises a coaxial cable—particularly with respect to wireless and radio frequency devices. Unbalanced impedance 30, however, may be realized by various unbalanced substitutes and alternatives. As shown, unbalanced impedance 30 is coupled with a radio frequency device 40, such as a receiver, transmitter or transceiver.

Antenna structure 10 couples first and second conductive leaves, 14 and 18, with unbalanced impedance 30 by means of a balun 50. Balun 50 converts a balanced signal propagating through first and second conductive leaves, 14 and 18, to an unbalanced signal for unbalanced impedance 30, and vice versa. In this manner, the operation of balun 50 may be modeled as a transformer having one side of its secondary coils grounded. Balun 50 comprises a pair of tuned transmission line ends or stubs to perform this conversion function. More particularly, on the exposed dielectric side of substrate 20, balun 50 comprises a stub 26 formed from tapered slot 22. Balun 50 further comprises a second stub 64 formed from a conductive strip or stripline 60. Stripline 60 and second stub 64 are formed on the underside of substrate 20—opposite to the side of conductive leaves, 14 and 18. Consequently, balun 50 comprises stubs, 26 and 64, separated by a dielectric in the form of substrate 20, for coupling conductive leaves, 14 and 18, with unbalanced impedance 30. The length of each stub, 26 and 64, of balun 50 is measured to provide constructive interference from the electromagnetic wave reflections propagating through conductive leaves, 14 and 18, and conductive stripline 60. For example, the length of each stub, 26 and 64, is approximately one-quarter wavelength ($\lambda/4$) from the desired frequency.

The inclusion of balun 50, however, has a limiting effect on the frequency response of antenna structure 10. While each stub, 26 and 64, supports the electromagnetic coupling necessary for balun 50 to convert balanced signals to unbalanced signals, and vice versa, both stubs alter the frequency response of antenna structure 10. Consequently, by incorporating an increasing number of baluns—and thereby a greater number of stubs—the frequency response of antenna structure 10 may be characterized as having an increasingly narrower passband transfer function.

The passband transfer function of an antenna structure employing a balun has now become a problem. Presently, a growing commercial interest exists in providing an increasing number of services to wireless devices. In an effort to minimize the additional antenna structures required for each of these increased services, and thereby reduce the complexity of such a wireless device, industry has begun to explore a singular antenna structure having a broader frequency response. As such, an alternative to balun 50 is needed to widen the frequency response and increase the number of frequency bands supported by a singular antenna structure.

Figure 2:
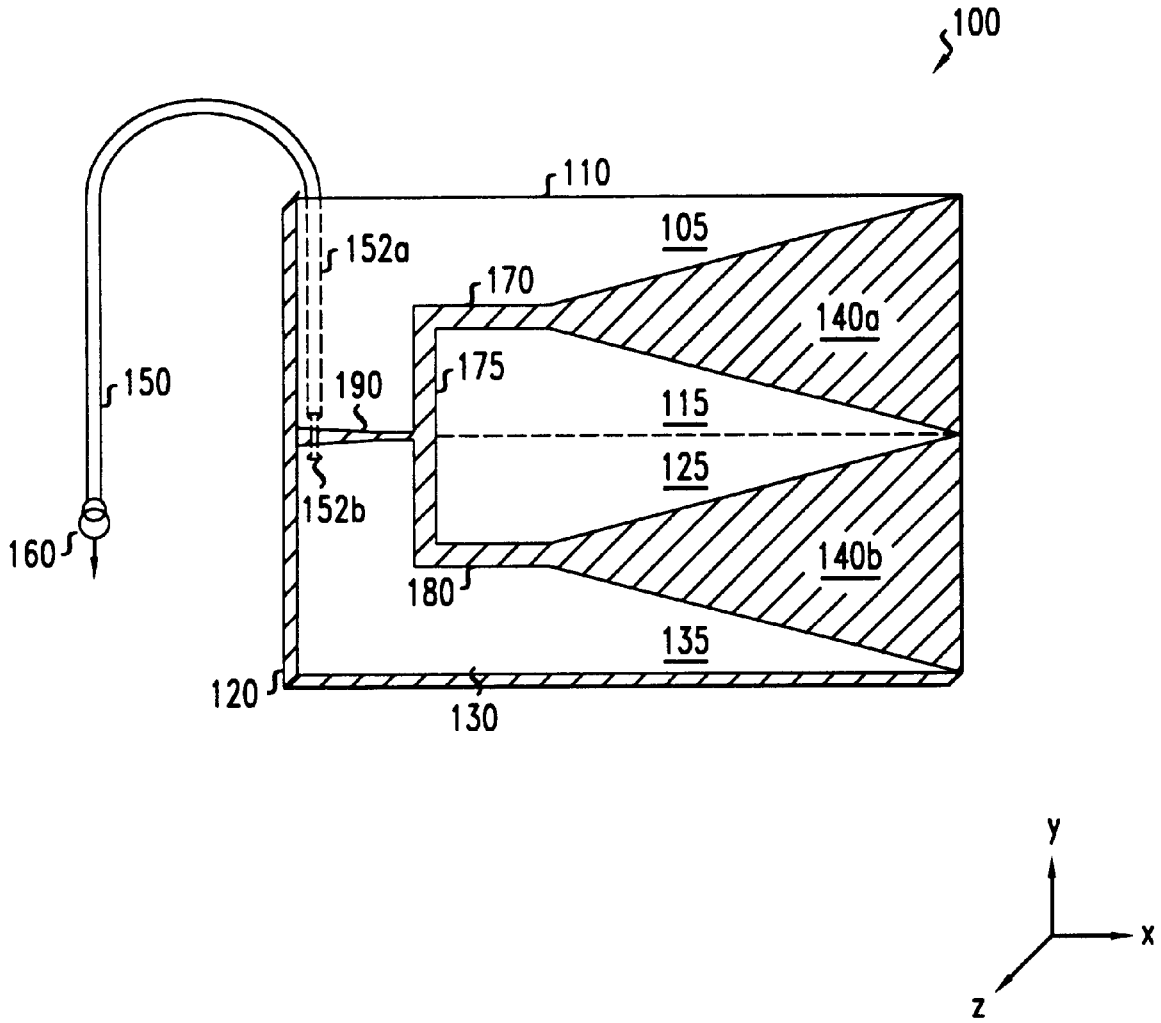
FIG. 2 is a perspective view of an embodiment of the present invention.

Referring to FIG. 2, a perspective view of an embodiment of the present invention is illustrated. Here, an antenna structure 100 is shown employing an alternative to a balun. Antenna structure 100 has a broader frequency response and supports an increased number of frequency bands than antenna structure 10 of FIG. 1.

As shown, antenna structure 100 comprises a first and a second balanced impedance, 110 and 130, each of which realize an antenna element. It will be apparent to skilled artisans that antenna structure 100 may comprise any number of antenna elements (i.e., one or more) in accordance with the present invention. First antenna element 110 of antenna structure 100 comprises a first and a second conductive film or leaf, 105 and 115, supporting the propagation of balanced signals therethrough. Similarly, second antenna element 130 comprises a third and a fourth conductive leaf, 125 and 135, supporting the propagation of balanced signals therethrough. First and second leaves, 105 and 115, of first antenna element 110, as well as third and a fourth conductive leaves, 125 and 135, of second antenna element 130 are separated from each other by a pair of non-conductive, expanding tapered slots 140*a* and 140*b*. Tapered slots 140*a* and 140*b* expose the dielectric characteristics of a dielectric substrate 120.

Antenna structure 100 has a planar, travelling wave design. Both first and second antenna elements, 110 and 130, are coupled in parallel with one another such that antenna structure 100 may be classified as an endfire type, radiating or capturing electromagnetic energy along the x-axis. To ensure the propagation of electromagnetic energy along the x-axis, however antenna elements, 110 and 130, are driven—radiating and/or capturing—in phase with one another. Moreover, by the expanding shape of tapered slots 140*a* and 140*b*, each antenna element, 110 and 130, may have a Vivaldi configuration. Vivaldi or tapered slot antenna elements are known to have wider frequency response characteristics than other antenna element configurations, such as dipole antennas. For more information on Vivaldi and tapered slot antennas, see, for example, K. Fong Lee and W. Chen, "Advances in Microstrip and Printed Antennas," John Wiley & Sons (1997). It will be apparent to skilled artisans upon reviewing the instant disclosure, however, that antenna structure 100 may have alternative configurations, designs and classifications, while still embodying the principles of the present invention.

Coupled with antenna structure 100 is an unbalanced impedance 150. Unbalanced impedance 150 comprises a first conductor in which unbalanced signals propagate therethrough with respect to a second conductor (i.e., ground). Unbalanced impedance 150 may be realized by a coaxial cable, though various substitutes and alternatives will be apparent to skilled artisans upon reviewing the instant disclosure. Unbalanced impedance 150 is coupled with a radio frequency device 160, such as a receiver, transmitter or transceiver. Unbalanced impedance 150 comprises an outer conductor 152*a* (i.e., the ground) which is electrically and mechanically coupled (e.g., soldered) with first antenna element 110, and a center conductor 152*b* (i.e., the first conductor) which is electrically and mechanically coupled (e.g., soldered) with second antenna element 130. The coupling of a coaxial cable with a balanced impedance is shown in greater detail in FIG. 5.

Antenna structure 100 couples first and second antenna element, 110 and 130, with unbalanced impedance 150 by means of a slotted transmission network. In accordance with the present invention, this slotted transmission network converts a balanced signals propagating through each set of conductive leaves, 105 and 115, and 125 and 135, to an unbalanced signal for unbalanced impedance 150, and vice versa. However, unlike balun 50 of FIG. 1, we have observed that the slotted transmission network of the present invention does not generally narrow the frequency response of antenna structure 100. Consequently, this slotted transmission network supports an increased number of frequency bands than is presently available in the known art.

As shown in FIG. 2, the slotted transmission network comprises a number of slotted transmission lines. The number and configuration of slotted transmission lines necessary to perform the conversion to replace known balun designs is dependent on several variables. These variables include, for example, the number of antenna elements in antenna structure 100, as well as whether the antenna elements are coupled in parallel or in series. It should be noted that the dimensions and the dielectric constant of the substrate materials correspond with the resultant impedance of each slotted transmission line in the slotted transmission network. The mathematical relationship between a slotted transmission line and its resultant impedance is known to skilled artisans. For more information on the principles involving the resultant impedance of a slotted transmission line, see K. C. Gupta, R. Gard, I. Bahl, and P. Bhartia "Microstrip Lines and Slotlines, " Artech House (1996).

In the illustrative embodiment, first antenna element 110 comprises a first slotted transmission line or slotline 170 extending from tapered slot 140*a*. Similarly, second antenna element 130 comprises a second slotted transmission line or slotline 180 extending from tapered slot 140*b*. First and second slotlines, 170 and 180, are both balanced impedances. Slotlines, 170 and 180, each match the impedance of the antenna element to which it is coupled. A third slotted transmission line or slotline 175 is incorporated within the slotted transmission network for coupling first slotline 170 with second slotline 180. The slotted transmission network of FIG. 2 further comprises a fourth slotted transmission line or slotline 190 for interfacing third slotline 175 with unbalanced impedance 150.

In an instantiation of the illustrative embodiment, each antenna element, 110 and 130, of antenna structure 100 has an impedance of 100 Ω. As shown, antenna elements 110 and 130 are coupled in parallel with one another by means of third slotline 175, thereby yielding a matching impedance of 50 Ω. The impedance of third slotline 175 consequently matches that of unbalanced impedance 150—if impedance 150 is a coaxial cable having an impedance of 50 Ω. However, if the impedance of unbalanced impedance 150 does not match the impedance of third slotline 175, fourth slotline 190 may be tapered to alter the impedance seen by unbalanced impedance 150. The degree of tapering of fourth slotline 190 corresponds with the impedance desired—a wider mouth taper increases the impedance viewed by unbalanced impedance 150, while a narrower mouth taper decreases the impedance viewed by unbalanced impedance 150. The tapering of fourth slotline 190 operates much like the number of coils employed on a transformer for matching a first impedance with a second impedance. The tapering of a slotted transmission line to vary its impedance is known to skilled artisans. For more information on the principles of tapering slotted transmission lines, see "D. King, "Measurements At Centimeter Wavelength," Van Nostrand Co. (1952). Consequently, we have recognized that the slotted transmission network may be designed to effectively interface antenna structure 100 with a very wide range of impedance values attributed to unbalanced impedance.

Figure 3:
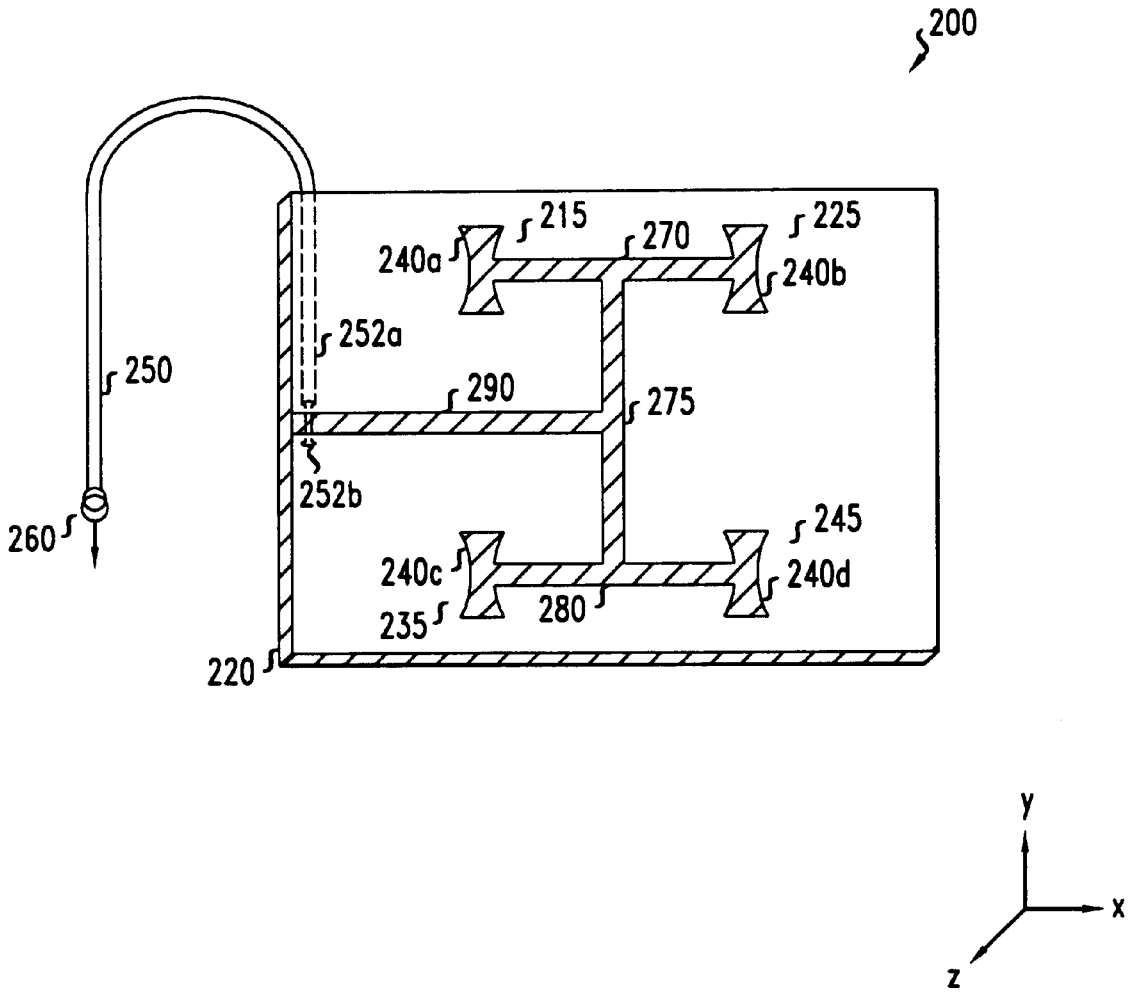
FIG. 3 is a perspective view of another instantiation of the present invention.

Referring to FIG. 3, a perspective view of another instantiation of the present invention is illustrated. Here, an antenna structure 200 is shown employing a slotted transmission network as an alternative to a balun. Antenna structure 200 may have a broader frequency response and support an increased number of frequency bands than antenna structure 10 of FIG. 1.

In contrast with antenna structure 100 of FIG. 2, antenna structure 200 is a planar, wave design having a broadside-type configuration. Antenna structure 200 is broadside-type because the ends of each antenna element are closed—i.e., they do not reach the outer periphery of a dielectric substrate 220. As such, antenna structure 200 radiates or captures electromagnetic energy along the z- axis.

As shown, antenna structure 200 comprises four (4) balanced impedances, 215, 225, 235 and 245, each realizing an antenna element. Antenna elements, 215, 225, 235 and 245, are coupled in parallel with one another by the slotted transmission network. Each antenna element is defined by an expanding pair of non-conductive, tapered closed slots—240*a* through 240*d*. Tapered closed slots 240*a* through 240*d* expose the dielectric characteristics of dielectric substrate 220. Each expanding tapered closed slot may have a horn-type shape to increase the frequency response of antenna structure 200. Horn-type antenna elements typically have a wider frequency response than that of a conventional slot dipole-type antenna element. Each expanding tapered closed slot, 240*a* through 240*d*, may also achieve resonance at the center of the desired frequency range. It will be apparent to skilled artisans upon reviewing the instant disclosure, however, that antenna structure 200 may have alternative configurations, designs and classifications, while still embodying the principles of the present invention.

Coupled with antenna structure 200 is an unbalanced impedance 250. Unbalanced impedance 250 comprises a first conductor in which unbalanced signals propagate therethrough with respect to a second conductor (i.e., ground). Unbalanced impedance 250 may be realized by a coaxial cable, though various substitutes and alternatives will be apparent to skilled artisans upon reviewing the instant disclosure. Unbalanced impedance 250 is coupled with a radio frequency device 260, such as a receiver, transmitter or transceiver. Unbalanced impedance 250 comprises an outer conductor 252*a* (i.e., the ground) which is electrically and mechanically coupled (e.g., soldered) with antenna element 215, and a center conductor 252*b* (i.e., the first conductor) which is electrically and mechanically coupled (e.g., soldered) with antenna element 235. The coupling of a coaxial cable with a balanced impedance is shown in greater detail in FIG. 5.

The antenna elements of antenna structure 200 are coupled with unbalanced impedance 250 by means of the slotted transmission network, in accordance with the present invention. This slotted transmission network converts the balanced signals propagating through each antenna element to unbalanced signals for unbalanced impedance 250, and vice versa. The slotted transmission network comprises a first slotted transmission line or slotline 270 for coupling the first antenna element, resulting from tapered closed slot 240*a*, in parallel with the second antenna element, resulting from tapered closed slot 240*b*. Likewise, a second slotted transmission line or slotline 280 couples the third antenna element, resulting from tapered closed slot 240*c*, in parallel with the fourth antenna element, resulting from tapered closed slot 240*d*. The first and second antenna elements, as combined, are coupled in parallel with the combined third and fourth antenna elements by means of a third slotted transmission line or slotline 275. A fourth slotted transmission line or slotline 290 interfaces unbalanced impedance 250 with the resultant balanced impedance created by the parallel combination of each of the antenna elements of antenna structure 200.

In an instantiation of the illustrative embodiment, each antenna element of antenna structure 200 has an impedance of 300 Ω. As antenna elements 215 and 225 are coupled in parallel, first slotline 270 is designed to have a matching impedance therewith—i.e., 150 Ω. Similarly, as antenna elements 235 and 245 are coupled in parallel, second slotline 280 is designed to have a matching impedance therewith—i.e., 150 Ω. Third slotline 275 also couples the other two antenna elements, yielding a total matching impedance of 75 Ω. Consequently, the impedance of slotline 290 may be designed to match that of unbalanced impedance 250—for example, if impedance 250 is a 75 Ω coaxial cable. However, if the impedance of unbalanced impedance 250 does not match the impedance of third slotline 275, fourth slotline 290 may be tapered to alter the impedance seen by unbalanced impedance 250. The degree of the taper corresponds with the amount the impedance to be altered—a wider mouth increases the impedance viewed by unbalanced impedance 250, while a narrower mouth decreases the impedance viewed by unbalanced impedance 250. Consequently, if unbalanced impedance 250 was realized by a 50 Ω coaxial cable, fourth slotline 290 may be tapered to step down the impedance of antenna structure 200 and create a matching 50 Ω impedance for unbalanced impedance 250.

Figure 4A:
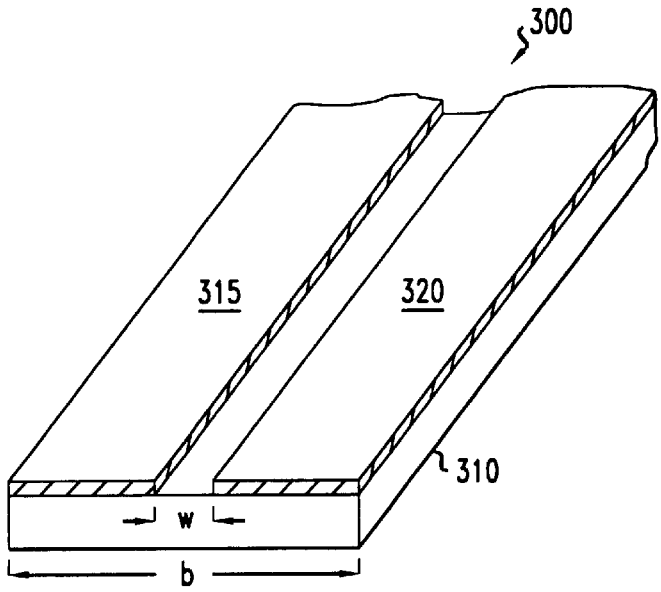
FIG. 4(*a*) is a perspective view of a known slotted transmission line, while FIG. 4(*b*) illustrates the electric and magnetic fields of the known slotted transmission line of FIG. 4(*a*)
Figure 4B:
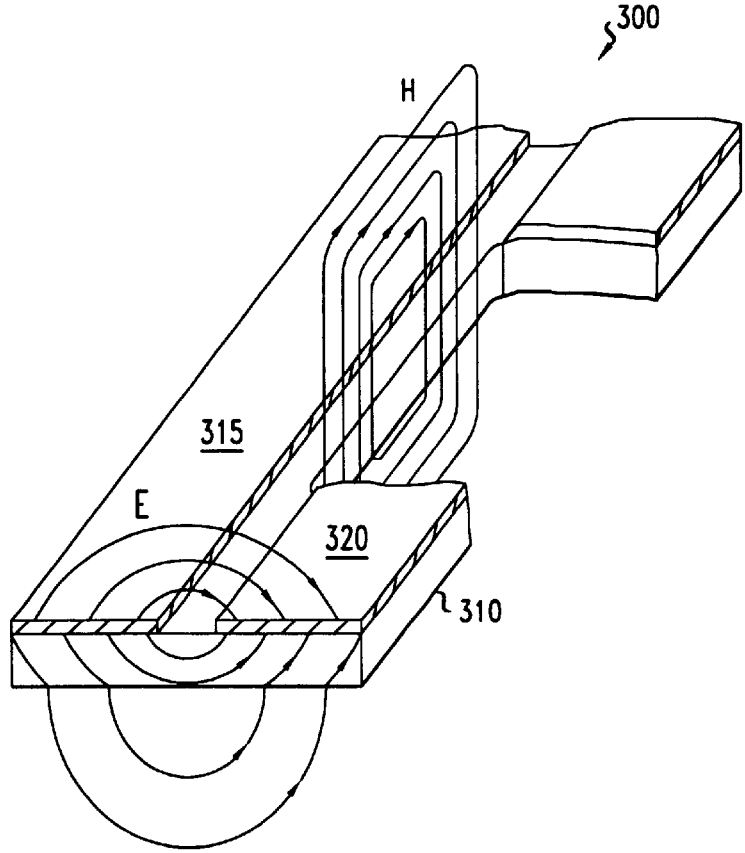

Referring to FIG. 4(*a*), a perspective view of a known slotted transmission line or slotline 300 is illustrated. Slotline 300 comprises a slot on one side of a dielectric substrate 310 separating a first and a second conductive film or leaf, 315 and 320. More particularly, slotline 300 is defined by parameters W and b, as well as the dielectric constant of substrate 310. For more information on the mathematical relationship between a slotted transmission line and the resultant impedance, see K. C. Gupta, R. Gard, I. Bahl, and P. Bhartia "Microstrip Lines and Slotlines," Artech House (1996).

Referring to FIG. 4(*b*), the electromagnetic field distribution of slotline 300 is illustrated. Analyzing slotline 300 in the context of substrate 310, the dominant mode of propagation causes the electric field to form across the slot, and the magnetic field to encircle the electric field, though not being entirely in the same plane as the electric field. In contrast, the electric field of a coaxial cable or coaxial transmission line extends from the center conductor to the outer conductor or shield, with the magnetic field encircling the electric field entirely in the same plane.

To function as a transmission line and allow electromagnetic energy to propagate therethrough, it is advantageous for the electromagnetic fields to be closely confined within slotline 300. Close confinement may be practically achieved with slotline 300 by using a substrate having a sufficiently high dielectric constant. A dielectric constant ($\epsilon$) of at least two (2) may be sufficient, though a higher dielectric constant 100 or more may also be employed. Given the thickness of substrate 310, the lower the dielectric constant ($\epsilon$), generally, the more narrow the slotline dimensions needed to obtain the desired impedance. In one instantiation of the invention, slotline 300 comprises an alumina ($Al_2O_3$) substrate having a dielectric constant of about 9.5.

Figure 5:
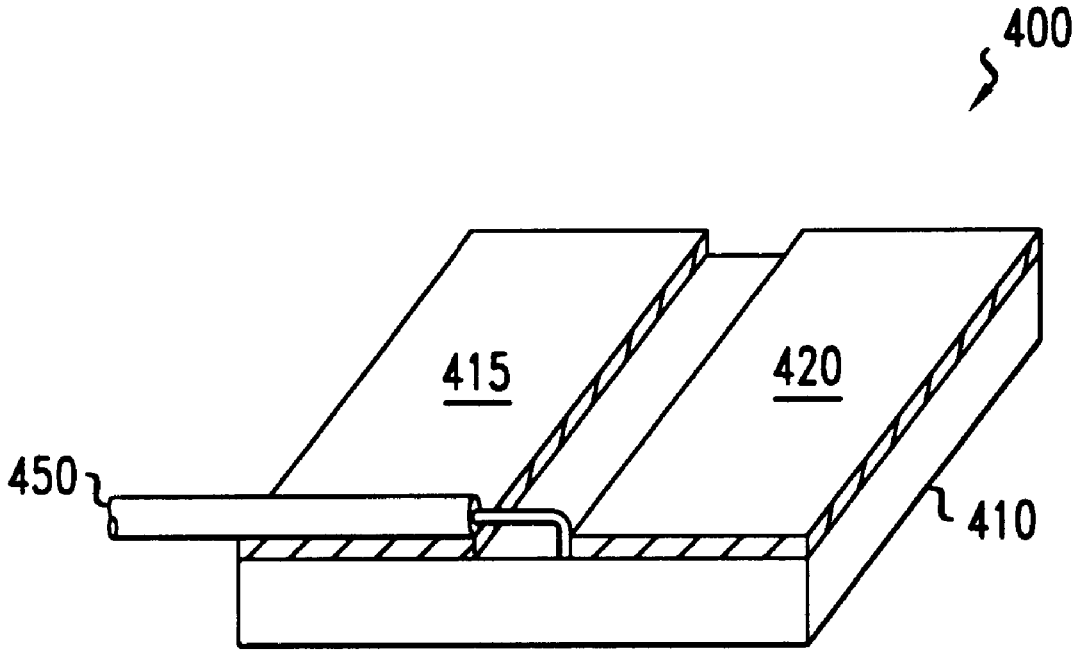
FIG. 5 is a perspective view of a known element.

Referring to FIG. 5, a planar view of the coupling of a balanced impedance 400 and an unbalanced impedance 450 is illustrated. More particularly, balanced impedance 400 is realized here by a slotted transmission line, while unbalanced impedance 450 is realized by a coaxial cable. Coaxial cable 450 comprises an outer conductor and an inner conductor. The outer conductor of coaxial cable 450 is electrically and mechanically coupled (e.g. soldered) with a first conductive film or leaf 415 of slotted transmission line 400. Moreover, the inner conductor of coaxial cable 450 is electrically and mechanically coupled (e.g. soldered) with a second conductive film or leaf 420.

Various methods of making the antenna structures and slotted transmission networks of the present invention will be apparent to skilled artisans upon reviewing the instant disclosure. Thick film technology may be used to fabricate electronic circuits on a variety of substrate materials for low frequency (i.e., in the 10 kHz range) and high frequency (i.e., in the 50 GHz range) applications. For example, circuits comprising at least one of gold, silver, silver-palladium, copper, and tungsten may be routinely formed using screen-printing circuit patterns of metal loaded, organic-based pastes onto $Al_2O_3$ substrates. Multilayer electronic devices may be formed by printing alternate layers of metal paste and a suitable dielectric paste. Vertical connections between metal conducting layers are accomplished with vias (e.g., metal filled holes). These patterns may be heat treated at an appropriate temperature—typically between 500° C. and 1600° C.—to remove the organic, consolidate the metal and/or dielectric and promote adhesion to the substrate.

Screen printing may involve the use of a patterned screen for replicating a circuit design onto a substrate surface. In this process, a metal or dielectric filled organic based paste or ink may be used to form the circuit or dielectric isolation layer. The paste may be mechanically and uniformly forced through the open areas of the screen onto the substrate. Specifically, the screen consists of wire mesh with a photoresist emulsion bonded to one surface and mounted on a metal frame for subsequent attachment to a screen printer. Photolithography may be used to pattern and develop the resist. The resist may be removed from those mesh areas where printing is desired. The remainder forms a dam against the paste spreading into unwanted areas. Screen design parameters (e.g., mesh size, wire diameter, emulsion thickness, etc.) directly affect the print quality. A line width and spacing of 50 microns may be possible, though 200 microns may be presently more practical. The fired metal thickness is typically in the range between 7 and 10 microns. A thickness of greater than 50 microns may be possible and controllable to within a few microns.

Figure 6:
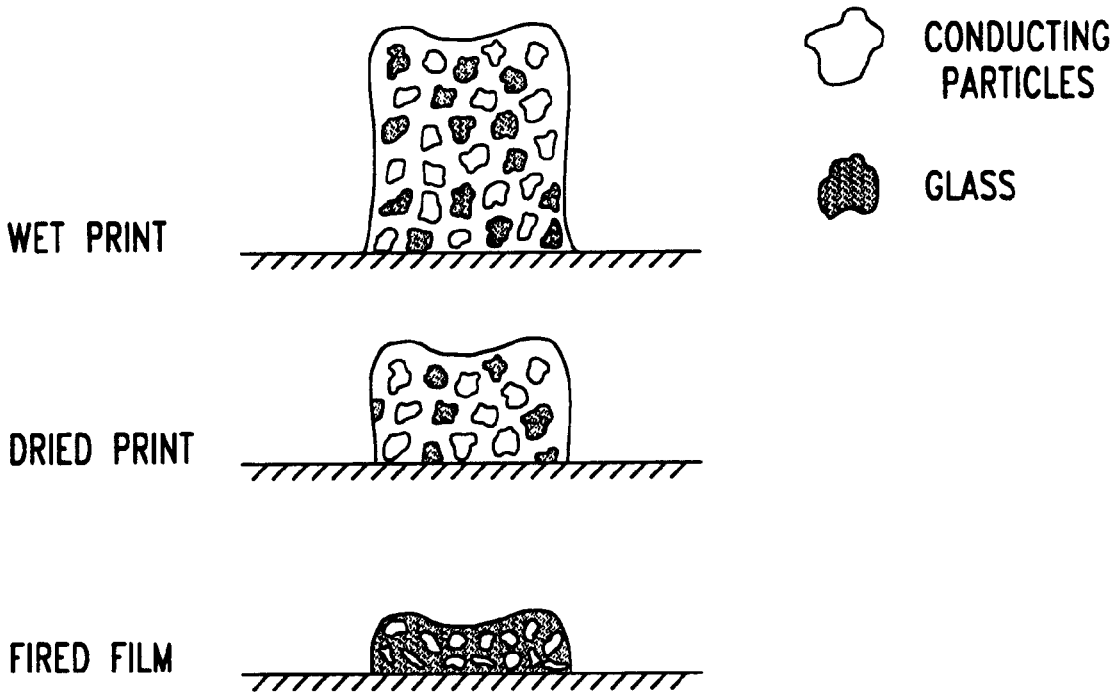
FIG. 6 is a process flow of an aspect of the present invention.

A screen printable paste is comprised of a metal powder dispersed in an organic mixture of binder(s), dispersing agent(s) and solvent(s). Controlling the paste rheology may be critical for obtaining acceptable print quality. Printing occurs by driving the squeegee (e.g., a hard, angular shaped rubber blade) of a screen printer—hydraulically or electrically, for example—across the screen surface spreading the paste over the screen while forcing the area under the squeegee to deflect down against the substrate surface. Simultaneously, paste is forced through the open mesh of the screen, thus replicating the screen pattern on the substrate surface. After drying to remove the paste solvents, the metal and substrate are heated to an appropriate temperature, in a compatible atmosphere, to remove the remaining organic component(s), to consolidate the metal traces to provide low resistance conducting pathways and to promote adhesion with the supporting substrate. FIG. 6 illustrates the process flow schematically. Additional layers of dielectric insulator paste, paste to print discrete components (resistors, capacitors, inductors) and/or more metal circuits may be added to form more complex multilayer devices using this print, dry, fire process.

In making slotted transmission line 300 of FIG. 4(*a*), for example, it is not presently practical to form first and second conductive leaves, 315 and 320, along with a slotline having a width (W) of less than 100 microns using standard screen printing techniques. Slotline widths of between 40 and 100 microns may be achieved using a photo-printable thick film material such as DuPont's Fodel. This technique combines conventional thick film methods with the photolithography technology. Slotline widths of less than 100 microns are also readily formed by conventional photolithography. One such method completely coats the substrate with a conducting film by screen printing, though other common coating processes such as evaporation or sputtering of metal films, may also be employed. The metallized substrate is then covered with a photosensitive organic film (positive or negative resist). The organic film is then exposed to a collimated, monochromatic light source through an appropriately patterned glass mask to allow light to pass through specific areas of the mask, thereby creating a pattern, through polymerization, in the organic film. For a positive resist, the exposed area remains, as the substrate is washed with a suitable solvent. For a negative resist, the exposed area is removed by the solvent.

In one example, conductive leaves 315 and 320 of slotted transmission line 300 of FIG. 4(*a*) may be formed on a metal (e.g., $Al_2O_3$) covered substrate by exposing, through a patterned glass mask, a positive organic resist corresponding to leaves, 315 and 320. A solvent wash step removes the strip of unpolymerized organic film, exposing the substrate metallization corresponding to the desired width, W, of the slotline. An appropriate acid etching solution may be used to remove the exposed metallization and create the desired slotline. A second solvent wash may then be employed to remove the residual organic film.

While the particular invention has been described with reference to illustrative embodiments, this description is not meant to be construed in a limiting sense. It is understood that although the present invention has been described, various modifications of the illustrative embodiments, as well as additional embodiments of the invention, will be apparent to one of ordinary skill in the art upon reference to this description without departing from the spirit of the invention, as recited in the claims appended hereto. It is therefore contemplated that the appended claims will cover any such modifications or embodiments as fall within the true scope of the invention.

What is claimed is:

1. An antenna structure comprising:

at least one planar antenna element; each of the at least one planar elements having a balanced impedance, and a slotline for coupling the at least one planar antenna element with an unbalanced impedance.

2. The antenna structure of claim 1, wherein the unbalanced impedance comprises a coaxial cable having an outer conductor and an inner conductor, and the slotline comprises a pair of conductive slotline films separated by a slot therebetween, the slotline films each having an edge oriented transverse to the slot, the outer conductor being coupled at the edge of one slotline film and the inner conductor being coupled at the edge of the other slotline film.

3. The antenna structure of claim 1, wherein the at least one planar antenna element and the slotline are formed on a dielectric substrate.

4. The antenna structure of claim 1, wherein the balanced impedance comprises at least one pair of conductive films formed in the same plane as the slotline.

5. The antenna structure of claim 4, wherein the at least one pair of conductive films comprises a travelling wave antenna.

6. The antenna structure of claim 5, wherein travelling wave antenna comprises a tapered slot antenna.

7. The antenna structure of claim 6, wherein the tapered slot antenna comprises a Vivaldi antenna.

8. The antenna structure of claim 1, wherein the unbalanced impedance comprises a coaxial cable.

9. The antenna structure of claim 8, wherein the slotline has an impedance approximately matching an impedance of the coaxial cable impedance.

10. An antenna structure comprising:

an array of at least two planar antenna elements, each planar antenna element formed from a pair of conductive films on a dielectric substrate and each of the planar elements having a balanced impedance; and a slotline, formed on the dielectric substrate, for coupling each planar antenna element with an unbalanced impedance.

11. The antenna of structure of claim 10, wherein the unbalanced impedance comprises a coaxial cable having an outer conductor and an inner conductor, and the slotline comprises a pair of conductive slotline films separated by a slot therebetween, the slotline films each having an edge oriented transverse to the slot, the outer conductor being coupled at the edge of one slotline film and the inner conductor being coupled at the edge of the other slotline film.

12. The antenna structure of claim 10, wherein each balanced impedance comprises at least one pair of conductive films formed in the same plane as the slotline.

13. The antenna structure of claim 12, wherein each planar antenna element comprises a tapered slot antenna.

14. The antenna structure of claim 13, wherein the tapered slot antenna comprises a Vivaldi antenna.

15. The antenna structure of claim 10, wherein the unbalanced impedance comprises a coaxial cable.

16. The antenna structure of claim 15, wherein the slotline has an impedance approximately matching an impedance of the coaxial cable impedance.

* * * * *